US010694807B2

(12) United States Patent
Williams

(10) Patent No.: US 10,694,807 B2
(45) Date of Patent: Jun. 30, 2020

(54) SHOE HEEL PROTECTOR

(71) Applicant: Renée Clara Williams, Bloomfield, NJ (US)

(72) Inventor: Renée Clara Williams, Bloomfield, NJ (US)

( * ) Notice: Subject to any disclaimer, the term of this patent is extended or adjusted under 35 U.S.C. 154(b) by 0 days.

(21) Appl. No.: 15/236,498

(22) Filed: Aug. 15, 2016

(65) Prior Publication Data

US 2018/0042341 A1 Feb. 15, 2018

(51) Int. Cl.

| | |
|---|---|
| ***A43B 7/14*** | (2006.01) |
| ***A43B 21/22*** | (2006.01) |
| ***A43B 21/42*** | (2006.01) |
| ***A43C 19/00*** | (2006.01) |
| ***A43B 3/16*** | (2006.01) |

(52) U.S. Cl.

CPC ..... *A43B 7/14* (2013.01); *A43B 3/163* (2013.01); *A43B 21/22* (2013.01); *A43B 21/42* (2013.01); *A43C 19/00* (2013.01)

(58) Field of Classification Search

CPC ..... A43B 7/14; A43B 23/24; A43B 13/00; A43B 3/163; A43B 7/144; A43B 3/166; A43B 21/00; A43B 21/22; A43B 23/00; A43B 23/30; A43B 21/42; A43B 21/47; A43B 21/52; A43B 21/54

USPC ..... 36/100, 35 A, 69, 72 B, 73, 76 HH, 92, 36/105; D2/909, 910, 914, 915, 946, 965

See application file for complete search history.

(56) References Cited

U.S. PATENT DOCUMENTS

| | | | | | |
|---|---|---|---|---|---|
| 1,875,806 | A * | 9/1932 | Givens | A43B 3/166 | 36/72 B |
| 3,439,435 | A * | 4/1969 | Fredon | A43B 3/166 | 36/72 B |
| D591,033 | S * | 4/2009 | Patterson | D2/915 | |
| D809,254 | S * | 2/2018 | Hwang | D2/915 | |
| D864,532 | S * | 10/2019 | Hwang | D2/915 | |
| 2008/0196279 | A1* | 8/2008 | Epping | A43B 3/0078 | 36/726 |
| 2009/0217553 | A1* | 9/2009 | Jagger | A43B 21/42 | 36/72 B |
| 2011/0232137 | A1* | 9/2011 | Desiderio | A43B 3/0031 | 36/72 B |
| 2014/0250736 | A1* | 9/2014 | Zadeh | A43B 21/22 | 36/72 B |

* cited by examiner

*Primary Examiner* — William V Gilbert

(57) ABSTRACT

The concept of "Show Stopper Shoe Topper" is a covering to be positioned atop the heels of women's shoes to provide added strength and support while protecting this component of the footwear. The footwear accessory could provide wearers with added comfort as well as an eye-catching addition to the shoe. This protective product would consist of a cylindrical sleeve, produced from a durable rubber, which would rest atop the heel. Positioned upon the bottom of the "Show Stopper Shoe Topper" would be a circular base. I envision this product would be in the shape of a wine glass stem. I would be possible to produce the "Show Stopper Shoe Topper" in sizes to accommodate various styles and sizes of women's footwear. The "Show Stopper Shoe Topper" could be produced in heights from 2 to 10 inches with the width measuring 1/16 to 3/4 inch.

1 Claim, 2 Drawing Sheets

SHOE HEEL PROTECTOR

BACKGROUND OF THE INVENTION

Foot pain generally starts in one of three places: the toes, the forefoot or the hindfoot. Toe problems most often occur because of the pressure imposed by ill-fitting shoes. The forefoot is in the front of the foot. Pain originating in this area usually involves the metatarsal or sesamoid bones. The metatarsal or sesamoid bones are the two small bones embedded at the top of the first metatarsal bone, which connects to the big toe. The hindfoot is the back of the foot. Pain originating in this area can extend from the heel, across the sole (known as the plantar surface), to the ball of the foot (the metatarsophalangeal joint).

Nearly all causes of foot pain can be grouped under one of three causes. First, poorly fitting shoes are a frequent cause of foot pain. High-heeled shoes concentrate pressure on toes and can aggravate, if not cause problems with toes. Second, certain medical conditions that cause a disturbance in the way a person walks can contribute to foot pain. Common foot injuries include corns, calluses, blisters, muscle cramps, acute knee and ankle injuries, plantar fasciitis and metatarsalgia.

I've designed an accessory for use with women's footwear that could provide added strength for the heel while providing support for the woman's feet. This practical and convenient product would consist of a hard, durable, rubber sleeve that would sit atop the heel. This product would feature a circular base and would be produced in the shape of a wine glass stem. This invention would allow women to feel secure, comfortable and stable when walking in heels. The use of this product could prevent various foot problems that could lead to expensive and time consuming visits to a podiatrist.

SUMMARY OF RENEE CLARA WILLIAMS INVENTION

My invention is to be called the "Show Stopper Shoe Topper." The "Show Stopper Shoe Topper" is a covering to be positioned atop the heels of women's shoes to provide added strength and support while protecting this component of the footwear. This footwear accessory could provide wearers with added comfort as well as being an eye-catching addition to the shoe. This protective product would consist of a supportive cylindrical sleeve, produced from a durable rubber which would rest atop the heel. Positioned upon the bottom of the "Shoe Stopper Shoe Topper" cylindrical sleeve would be a sturdy circular base. The circular base would prevent the heel from getting caught in narrow spaces such as a metal grid on the ground. The product would resemble that of a wine glass stem with a circular sturdy base. I envision this product being in different sizes to accommodate various styles and sizes of women's footwear. Included could be kitten heels, pumps, stilettos, ankle strap heels, cone heels, sling back heels, platform heels, high heel sandals, mules, corset heels, etc. In addition, it would be produced in a plethora of colors that may be enlivened by various embellishments. Alternatively, the heel covering may be transparent to allow the heel to still be visible. The wearer would take the circular opening side and attach it to each heel of their shoes. The circular sturdy base touches the ground. The circular base can be made in varying widths and heights. The "Show Stopper Shoe Topper" is as easy as putting on a glove. It is a shoe accessory that can be used on virtually any type of heel. The "Show Stopper Shoe Topper" could be produced in heights from 2 to 10 inches with the width measuring of the cylindrical sleeve varying from 1/16 to 3/4 inch. There will be alternate versions of the shoe accessory made with a hallowed compression ball of varying sizes depended upon the shoe type inserted in the circular base for added comfort.

Possible versions of my invention that could be manufactured would be that shoe makers could start making heels with this type of heel if I do a licensing deal. Making shoes with this shape would revolutionize the way women's shoes are worn. Different heights, shapes, styles, base ideas, and colors are all possible. Different shapes depending on type of heel and different bases depending on how much support the individual needs. Different styles depending on the desire of the customer for their shoe type.

I believe this "Show Stopper Shoe Topper" would fulfill the need for a protective covering for women's heels that could provide wearers with enhanced support and added comfort. This product offers convenience, ease of placement and a reasonable price. This product also offers a protective covering which would save on repair and replacement of costly footwear. This product would be positioned atop the heels in order to protect them from damage while also enhancing their strength and support. The "Show Stopper Shoe Topper" will allow shoe wearers to feel secure as well as confident while helping them to maintain their balance in their heels. "The Show Stopper Shoe Topper" would be durable, lightweight, compact, and easily stored. It would be reasonably priced and reusable. Versions of the "Show Stopper Shoe Topper" could be produced in many sizes and shapes to accommodate a multitude of women's footwear. My product may also be produced in a plethora of colors and displaying a multitude of embellishments to enhance the appearance of the shoes. This may be of particular appeal with shoes featuring a worn or damaged heel. By providing women with added support and enhanced comfort, the use of the "Show Stopper Shoe Topper" may also reduce the incidence of various types of foot problems.

I was inspired to come up with this idea because I modeled in high school/college and years after on fashion runways. I ended up needing bunion surgery on both feet and corrective surgery on all my toes. I felt a need for a product that offered women more support to make wearing shoes with heels more comfortable and to give a woman more confidence. I believe this invention fulfills the need for a more comfortable heel.

During my pregnancies I never wore heels because I was not confident of the heel support. With this accessory, I would wear heels during pregnancy. Another benefit is this accessory lengthens how long a heel lasts. Also, it provides many useful options to women as to how they want their shoes to look while having the ease of use that allows them to slip this product on or off with ease. The inside of this cylindrical sleeve will be made of a material that is protective to the heel while giving enough grip that you won't ever have to worry about it ever slipping off from the heel.

The "Show Stopper Shoe Topper" could easily be produced using conventional and readily available materials and manufacturing processes. No new production technology would be required. The covering for the heel may be produced from a durable, molded rubber. It may also be made from natural rubber or Neoprene, GR-S, silicone, nitrile, butyl compounds, polyacrylate, and urethane elastomers which are some of the synthetic rubbers.

DETAILED DESCRIPTION OF THE PREFERRED EMBODIMENT

Figure 1:
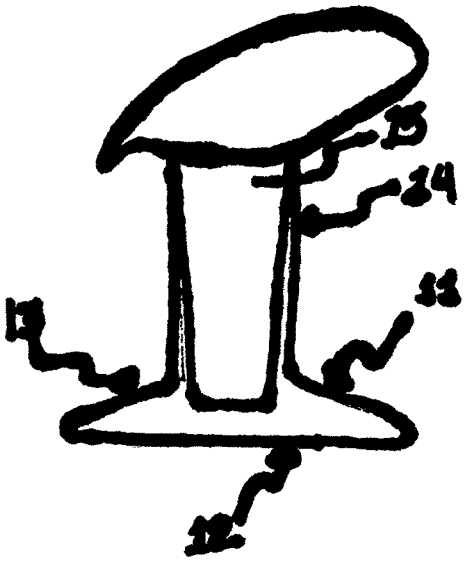
FIG. 1 is a side view of the shoe heel cover of the first embodiment of the invention secured on a heel of a shoe.

Referring to FIG. 1, shown is an illustrative drawing of a side view of the shoe heel cover 11 of the present invention. The present invention is a shoe heel cover 11 composed of a cylindrical sleeve 14 made of a durable molded rubber and a circular base of the shoe heel cover 12 also comprised of durable molded rubber. The shoe heel cover 11 will provide added strength while protecting this component of the footwear.

Figure 2:
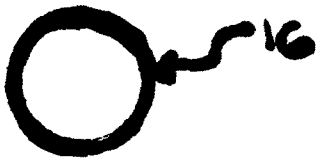
FIG. 2 is bottom view of the circular sturdy base of the shoe heel cover.

Referring to FIG. 2, shown is an illustrative drawing of the circumferential small-sized; example of bottom surface of base portion of the shoe heel cover 11. The base is also comprised of a durable, molded rubber such as silicone, nitrile, butyl compounds, polyacrylate, and urethane elastomers. The sturdy circular base will help individuals feel secure to maintain balance while wearing heels.

Figure 3:
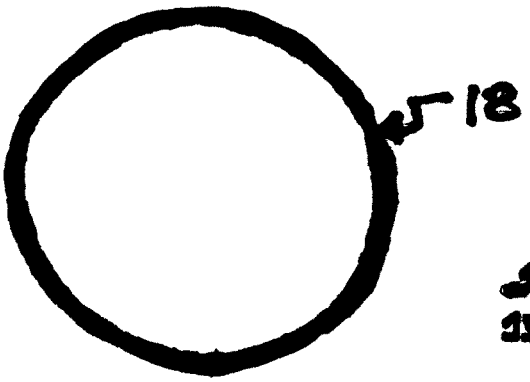
FIG. 3 is another version of the bottom view of the circular sturdy base of the shoe heel cover demonstrating the she heel cover base in different sizes.

Referring to FIG. 3, shown is an illustrative drawing of an alternate circumferential large-sized example of bottom surface of base portion of the shoe heel cover 11. The base is also comprised of a durable, molded rubber such as silicone, nitrile, butyl compounds, polyacrylate, and urethane elastomers to name a few. The sturdy circular base 12 will help individual secure to maintain balance while wearing heels.

Figure 4:
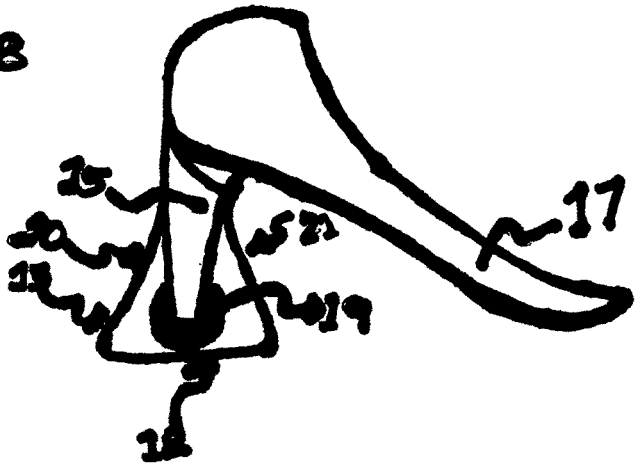
FIG. 4 is a cross-sectional side view of the shoe heel cover of the second embodiment of the invention which contains a hallowed out compression ball in the shoe accessory.

Referring to FIG. 4, shown is an illustrative cross-sectional side view of the shoe heel cover of the second embodiment 21 comprised of the wine-stem shaped shoe heel cover 11 with a hallowed out compression ball 19 making it an alternative version of the shoe heel cover 21. As shown, the shoe heel cover comprises a shoe heel cover and base 12 is also made of a durable molded rubber. As with the shoe heel cover 21 would be made in various sizes to accommodate varying styles and sizes of women's footwear. It could be produced in a plethora of colors that may be enlivened by various embellishments. The shoe heel covering 21 could also be produced in a range of heights and widths.

Figure 5:
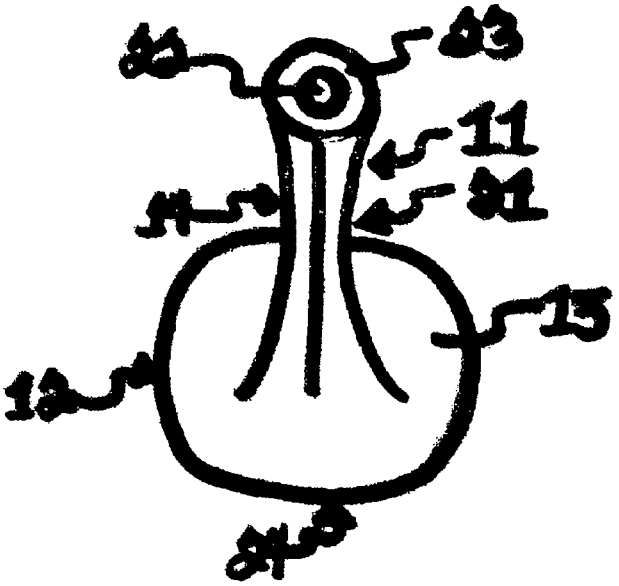
FIG. 5 is a perspective top view of the shoe heel cover for the first and second embodiment.

Referring to FIG. 5, shown is an illustrative perspective top view 22 of the shoe heel cover for the first 11 and second embodiment 21. The circular insertion point 22 is made of durable molded rubber and the circumference will come in a variety of sizes to accommodate varying types of shoe heel stems.

DESCRIPTION OF THE REFERENCED NUMERALS

The referenced numerals follow the numbering used throughout the different figure drawings.

11. Shoe heel cover
12. Bottom of the shoe heel cover 11
13. Durable molded rubber of base portion 12
14. Durable molded rubber cylindrical sleeve of shoe heel cover 11
15. Shoe heel
16. Circumferential small-sized example of bottom surface of base portion of shoe heel cover
17. Shoe
18. Alternate circumferential large-sized example of bottom surface of base portion of shoe heel cover
19. Compression ball in the bottom portion of the shoe heel cover
20. Cross-sectional side view with a hollowed-out compression ball in the bottom portion of the shoe heel cover 19
21. Shoe heel cover with hollowed-out compression ball 19
22. Perspective top view of heel insertion point
23. Circumferential durable molded rubber of cylindrical sleeve wall
24. Frontal perspective view of the shoe heel cover

What is claimed is:

1. A heel cover for a heel of a shoe, comprising:

a base having an upper surface and a lower surface and being circular in shape, said base being made of rubber;

a cylindrical sleeve extending from said upper surface of said base, said cylindrical sleeve having a circular opening extending from an upper surface of said cylindrical sleeve and extending toward said base, said circular opening terminating in an end within said cover, said circular opening configured to receive a heel portion of a shoe;

a ball placed in said end of said cylindrical sleeve, said ball being hollow and configured to receive said heel of said shoe and facilitating compression when said heel cover is in use.

* * * * *